US009103156B1

(12) United States Patent
Vassilev

(10) Patent No.: US 9,103,156 B1
(45) Date of Patent: Aug. 11, 2015

(54) ATTACHABLE BUILT-IN BLINDS FOR DOORS AND WINDOWS

(76) Inventor: Anton Koytchev Vassilev, Tallahassee, FL (US)

( * ) Notice: Subject to any disclaimer, the term of this patent is extended or adjusted under 35 U.S.C. 154(b) by 1578 days.

(21) Appl. No.: 12/313,776

(22) Filed: Nov. 25, 2008

(51) Int. Cl.
*E06B 3/32* (2006.01)
*E06B 9/264* (2006.01)

(52) U.S. Cl.
CPC ..... *E06B 9/264* (2013.01)

(58) Field of Classification Search
CPC ..... E06B 9/264
USPC ..... 160/107, 98, 90; 49/61, 62, 63, 64, 65, 49/67
See application file for complete search history.

(56) References Cited

U.S. PATENT DOCUMENTS 1,743,783 A * 1/1930 Lancaster ..... 49/424
2,266,973 A 12/1941 Horton
2,288,465 A 6/1942 Knudsen
2,321,554 A 6/1943 Milnor
2,578,470 A 12/1951 Gorell et al.
3,326,267 A 6/1967 Hauck
4,184,297 A 1/1980 Casamayor
4,194,550 A * 3/1980 Hopper ..... 160/121.1
4,223,481 A 9/1980 Page
4,369,828 A * 1/1983 Tatro ..... 160/107
4,459,778 A * 7/1984 Ball ..... 49/64
4,611,648 A 9/1986 Anderson
4,733,510 A 3/1988 Werner
4,884,613 A * 12/1989 Komori et al. ..... 160/107
5,000,242 A * 3/1991 Coddens ..... 160/107
5,282,504 A 2/1994 Anderson et al.
5,325,579 A * 7/1994 Baier ..... 29/462
5,390,454 A * 2/1995 Coddens ..... 52/208
5,611,381 A * 3/1997 Jelic ..... 160/107
6,006,813 A * 12/1999 Jelic ..... 160/107
6,070,638 A * 6/2000 Jelic ..... 160/107
6,119,756 A * 9/2000 Tatro ..... 160/107

* cited by examiner

*Primary Examiner* — Katherine Mitchell
(74) *Attorney, Agent, or Firm* — Peter Loffler

(57) ABSTRACT

A blind system uses a typical door or window frame that has a hermetically sealed double glazing within an opening of its main frame. A blind assembly is removably received within a rabbet of the main frame while a secondary frame is removably attached to the main frame by passing screws through the secondary frame, the screws being received within bosses located in the rabbet of the main frame, the secondary frame overlying the blind assembly. A single glazing is sealably attached to the secondary frame. The blind assembly is bordered by a spacer that holds a desiccant therein.

7 Claims, 2 Drawing Sheets

ATTACHABLE BUILT-IN BLINDS FOR DOORS AND WINDOWS

BACKGROUND OF THE INVENTION

1. Field of the Invention

The present invention is directed a door or window that has built-in blinds and more specifically to a blind that is easily removably attachable to the remainder of the frame of the door or window.

2. Background of the Prior Art

Doors and windows incorporating built-in blinds have gained in popularity in the last several years. In these types of systems, a blind is placed between the two panes of glass making up the door or window, the blind capable of being raised and lowered in the usual way. To achieve this construction, two sections of framing, each section holding one pane of glass, are brought together in order to capture the blind therebetween. Typically, the two sections are bolted to one another, often with the bolts visible on an exterior surface of the door or window. Control of the blinds is either manual via pull cords or control rods that pass through the frame so as to be accessible by a user or automatic via an electric motor which is tied into the building's electrical system.

The benefits of such systems lie in the fact that the blind is between the panes and thereby protected. The blinds do not accumulate dust in the manner that blinds attached separate from the window or door so accumulate. Additionally, the blinds are not subject to tearing or crushing from wayward kids and other hazards.

These benefits, are however, tempered with certain drawbacks. In a typical double pane door or window design, the double panes of glass are built as a single unit with the two panes being located in spaced apart relationship to one another with a spacer positioned therebetween around the entire outer periphery of the panes. The spacer is often made from aluminum or vinyl and also has a rubber gasket (often butadiene) along its entire length. In addition to spacing the panes from one another, the spacer acts as a thermal break and the gasket hermetically seals the two panes to one another so as to create dead air space in the cavity between the two panes. This dead space helps the overall door or window achieve greater thermal insulation. The cavity is often filled with a desiccant such as silica sand and an insulating gas such as Argon. The hermetically sealed double pane unit is secured within the remainder of the frame. In a built-in blind door or window, such a hermetic seal cannot be achieved due to the fact that either a manual blind control operator or an electric cord must protrude out from the cavity between the panes, thereby preventing the seal described above. Although the exit point of the control operator or electric cord is provided with appropriate seals, such seals can become less effective over time. In the case of a manual control operator passing through this sealed exit point, the manual control operator passes a physical force through the seal. This physical force acts on the seals which can become less effective over time. In an automatic control configuration, the vibration from the motor acts on the seals that seal the exiting electric cord. Once the seals become sufficiently loose, the Argon gas escapes, not only robbing the door or window of some of its insulating properties, but also allowing a bellowing effect on the panes to increase thereby further reducing the thermal insulating properties of the structure. In the case of interior doors, this tends not to be a problem. However, many of these types of doors and windows are used on the exterior of the building where thermal insulation is a concern.

Another shortcoming of the present double pane built-in blind systems is that in order to change a blind, such as during remodeling, the door or window bearing the blind must be disassembled in order to swap out the blind and thereafter reassembled in order to seal the structure. In order to achieve the maximum thermal insulating capability, including the replacement of the Argon gas into the cavity between the panes, a trained professional using specialized equipment is often needed to accomplish this swap out, which can be very expensive.

What is needed is a built-in blind system for a door or window that allows the panes forming the structure to be hermetically sealed in the usual way in order to achieve a high level of thermal insulation yet allow a building owner to be able to quickly and easily replace blinds without the need to summon a professional window installer. Similarly, a break in a pane should be a relatively easy fix. Ideally, such a system should be of relatively simple design and construction so as to be readily affordable to a large segment of building owners.

SUMMARY OF THE INVENTION

The attachable built-in blinds for doors and windows of the present invention addresses the aforementioned needs in the art by providing a system wherein built-in blinds can be easily and quickly removed from and attached to a door or window frame without the need for a professional installer, all the while maintaining high overall thermal efficiency of the door or window. The attachable built-in blinds for doors and windows is of relatively simple design and construction using standard manufacturing techniques to produce so as to be relatively affordable for a large segment of the potential buyers for this type of product.

The attachable built-in blinds for doors and windows of the present invention is comprised of a main frame that is attached to an opening within a building. The main frame has a first opening such that a hermetically sealed double glaze pane assembly is sealed within this first opening. The main frame has a rabbet on an interior surface (although an exterior surface configuration is also possible) of the main frame. The main frame also has a series of second openings spaced about the first opening, the second openings being located within the rabbet. A series of screw bosses are provided such that each screw boss is each disposed within a respective one of the second openings. A blind assembly is removably received within the rabbet of the main frame and abuts the pane assembly. A secondary frame has a third opening such that a single glaze pane is attached to the secondary frame in covering relationship with the third opening. The secondary frame is removably attachable to the main frame by having the rabbet of the main frame snugly receive the secondary frame whereupon a series of screws pass through the secondary frame, such that each screw is received within a respective one of the screw bosses. In this position, the secondary frame, and more specifically the single glaze pane overlies the blind assembly. A spacer is adhered to an inner surface of the main frame such that the spacer borders the blind assembly on up to three sides. A first sealing gasket is adhered to the blind frame and spacer on a first side of the gasket and to the single glaze pane on an opposing side. The single glaze pane is attached to the secondary frame by a second sealing gasket that attaches to and encompassing the entire third opening of the secondary frame and attaches to the single glaze pane proximate an outer periphery of the single glaze pane. The spacer is filled with a desiccant.

BRIEF DESCRIPTION OF THE DRAWINGS

Similar reference numerals refer to similar parts throughout the several views of the drawings.

DESCRIPTION OF THE PREFERRED EMBODIMENT

Figure 1:
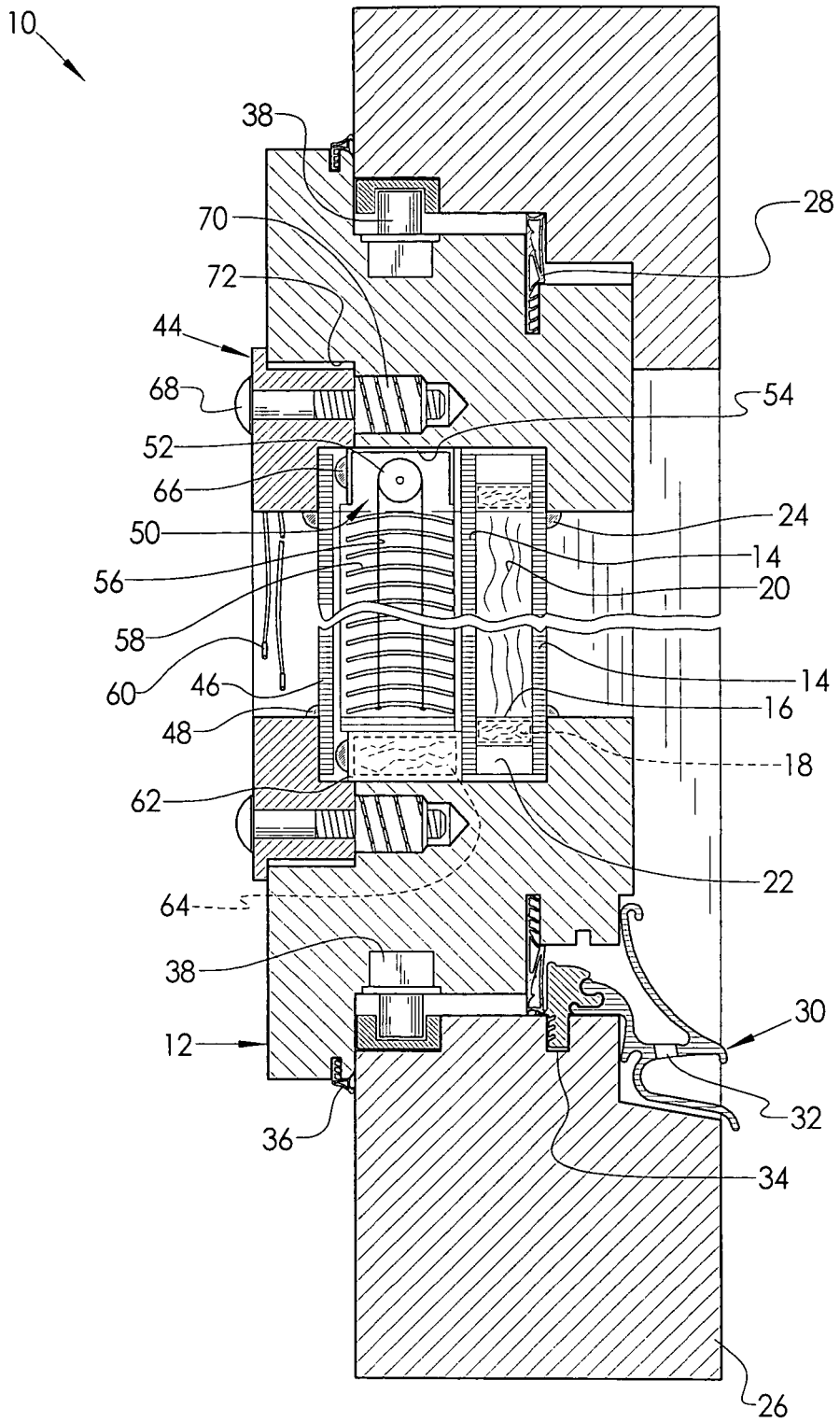
FIG. 1 is a side sectioned view of the attachable built-in blinds for doors and windows of the present invention.
Figure 2:
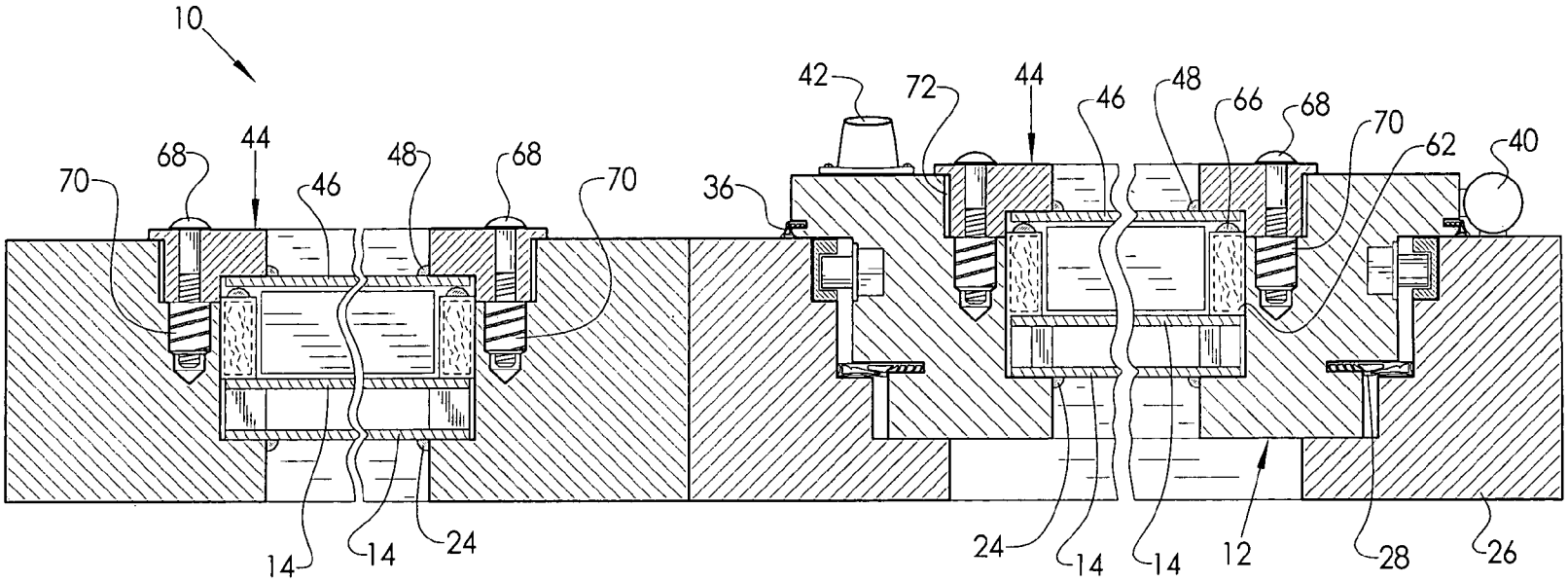
FIG. 2 is a top sectioned view of the attachable built-in blinds for doors and windows in a two window configuration.

Referring now to the drawings, it is seen that the attachable built-in blinds for doors and windows of the present invention, generally denoted by reference numeral 10, is comprised of a main frame 12 which is a typical window or door frame and may be made from any appropriate materials for the specific product (wood, vinyl, aluminum, etc., for a window configuration, steel, fiberglass, wood, etc., for a door configuration). Although the drawings illustrate the attachable built-in blinds for doors and windows 10 within a window setting, the present invention is equally applicable to doors in substantially the same manner described herein. As seen in FIG. 1, the main frame 12 has a pair of spaced apart glazing panes 14 installed therein, the glazing panes 14 being installed as a single hermetically sealed unit as is common in the art and sitting on a ledge within an opening of the main frame 12. Specifically, a spacer 16 encompasses the entire outer periphery (or proximate thereto) of the spaced apart glazing panes 14 to which the panes 14 are attached in appropriate fashion, with the inner space of the spacer 16 being filled with an appropriate desiccant 18 such as silica sand while the cavity formed between the panes is filled with an appropriate insulating gas 20 such as Argon. A glaze sealing gasket 22 is attached to the outer surface of the spacer 16 as well as to each of the pair of glazing panes 14, the sealing gasket 22, made from silicone, butadiene, etc., provides the overall hermetic seal for the double pane 14 assembly. An outer sealing gasket 24 (made from silicone and the like) is used to seal the outer surface of the outer glazing pane 14 with the main frame 12. The main frame 12 is installed within an opening of a building in the usual way, either directly or via an outer frame 26, the specific installation being dependant on what type of window (casement, awning, fixed, etc., or whether the present invention 10 relates to a door) is being installed. As seen in FIG. 1, in a slider configuration, an outer frame 26 is provided, the outer frame 26 holding the main frame 12. Compression sealing gaskets 28 (made from an appropriate resilient material such as rubber) are attached to an outer surface of the main frame 12 whereat such outer surface faces a portion of the outer frame 26 and/or to the outer frame 26, in order to help prevent moisture intrusion past the main frame 12 in order to form a compression seal between the main frame 12 and the outer frame 26. While a portion of the outer frame 26 overhangs the upper portion of the main frame 12, the lower portion of the main frame 12 is protected by the use of an outfall assembly 30 which has a weep hole 32 therein to channel any water that gets therein down and out of the window assembly 10. The outfall assembly 30 is positioned within a channel 34 located along a portion of the upwardly facing surface of the outer frame 26. An inner sealing gasket 36 encompasses an outer side surface of the main frame 12 and abuts up against an inner surface of the outer frame 26 in order to provide an additional seal for the main frame 12. Appropriate locks 38 may be provided. As seen in FIG. 2, two additional examples of main frame 12 to building installation are provided such that a fixed window (left side of the figure) has a more simple main frame 12 configuration, in that the hermetically sealed double glazing panes 14 are installed within the main frame 12 and sealed to the main frame 12 via the outer sealing gasket 24. The main frame 12 itself is attached to the building in appropriate fashion. As further seen in FIG. 2, an operable window (right side of the figure), the main frame 12 is attached to the outer frame 26 via at least one hinge 40 while the hermetically sealed double panes 14 are also installed within the main frame 12 and sealed to the main frame 12 via the outer sealing gasket 24. This configuration also uses the compression gaskets 28 for creating a compression seal between the main frame 12 and the outer frame 26 and an inner sealing gasket 36 encompasses an outer side surface of the main frame 12 and abuts up against an inner surface of the outer frame 26 in order to provide an additional seal for the main frame 12. Locks 38 are also provided for this operable window as is an optional stop 42 to help prevent damage to an interior surface of the building whenever the main frame 12 is fully opened. A lower gasket assembly 30 (not illustrated in this figure) is also provided. The two main frames 12 in FIG. 2, which do not necessarily need to be built together, can be mulled together in any appropriate fashion.

A secondary frame 44 is provided, the secondary frame 44 being made from the same material as the material used to make the main frame 12. A single glaze pane 46 is attached to the secondary frame 44 by a sealing gasket 48 (silicone, etc.).

A blind assembly 50 has the typical blind hardware including a take up reel 52 that is attached to a blind frame 54, hang cords 56 descending down from the take up reel 52, a blind 58, either being comprised of the illustrated slats or a single blind sheet (not illustrated) attached to the hang cords 56, blind control cords 60, etc. It is specifically understood that while the figures illustrate a blind assembly 50 that uses a pull cord type controller 60 for controlling the taking up and releasing of the blind 58 as well as for changing the pitch of the blind slats if used, other controllers that are known in the art for controlling the blind 58 can be used with the attachable built-in blinds for doors and windows 10 of the present invention.

A spacer 62, filled with a desiccant such as silica sand, is adhesively attached to an inner surface on the opening of the main frame 12 and to one of the glaze panes 14. The blind assembly 50 is then inserted into the main frame's opening such that the spacer 62 encompasses the blind assembly 50 on up to three sides. Advantageously, although not necessarily, a portion of the main frame 12 conceals the hardware of the blind assembly 50 from view through the double glaze assembly 14. A gasket 66 is interposed between the spacer 62 and the secondary frame 44 and between the blind frame 54 and the secondary frame 44. The entire secondary frame 44 overlies the blind assembly 50 and is removably attached to the main frame 12 by passing a series of screws 68 through the secondary frame 44, with the screws 68 being received within appropriate screw bosses 70 disposed within the main frame 12, the number of screws 68 being dependant on the overall dimensions of the attachable built-in blinds for doors and windows 10. Advantageously, although not necessarily, a portion of the secondary frame 44 conceals the hardware of the blind assembly 50 from view through the single glaze pane 46. The screws 68 may be the illustrated flat head screws for an aesthetic appearance and may have rounded heads, instead of the illustrated hex heads, in order to provide a security type of bolt attachment. As can be seen, the secondary frame 44 is disposed within a rebate or rabbet 72 on the interior surface of the main frame 12 in order to achieve an overall slim design for the door or window. The rabbet 72 is dimensioned to be the just slightly larger than the dimensions of the portion of the secondary frame 44 that is received within the rabbet 72 (most of the blind assembly 50 is received within the normal opening of the main frame 12) in order to provide a snug and secure fit. By using a rabbet 72, the overall structure 10 remains relatively slim and sleek for what is a three glaze 14, 14, and 46, design. The rabbet 72 of the main frame 12 carries a substantial portion of the gravitation load of the secondary frame 44 which allows the uses of smaller and/or fewer screws 68 for a more aesthetic appearance of the finished structure 10.

In order to use the attachable built-in blinds for doors and windows 10 of the present invention, the main frame 12 is attached to the building in the usual way such as via one of the examples discussed above or other appropriate way. Once the main frame 12 is properly installed, the blind assembly 50 is positioned within the main frame 12 abutting the double glaze assembly 14 and the secondary frame 44 is attached to the main frame 12 thereby providing the overall door or window with blinds 58 yet maintaining the standard hermetically sealed double glazing 14. As the single glaze pane 46 is attached to the secondary frame 44 via a sealing gasket 48, the secondary frame 44 and single glaze pane 46 help provide an additional level of thermal sealing for the overall door or window. As the blind assembly 50 is surrounded on at least three sides by a spacer 62 holding a desiccant 64, any moisture that might intrude into the blind assembly 50 area is absorbed by the desiccant 64 and does not fog up the pane 46. When access to the blind 58 is needed, such as to replace the blind 58, fix the blind mechanism, etc., the screws 68 are unscrewed so as to allow the secondary frame 44 to be detached from the main frame 12 and the components of the blind assembly 50 are accessed as desired. While the secondary frame 44 is in a detached configuration from the main frame 12, the main frame 12 functions as a door or window in the usual way. Thereafter, the secondary frame 44 is reattached to the main frame 12 as described earlier. As the secondary frame 44 is attached to an inner surface (interior surface within the building) of the main frame 12, the secondary frame 44 can be detached from the main frame 12 as needed, even if the temperature outside is cold or otherwise the weather inclement, however, it is understood that a reverse design is possible with the secondary frame 44 being located on an exterior of the door or window. As the secondary frame 44 is seated within a rabbet 72 of the main frame 12, the overall door or window is of relatively slim and compact design for this type of door or window and is also relatively lightweight so as to help minimize the potential for problems, such as sash sag, typical with relatively heavier structures.

While the invention has been particularly shown and described with reference to an embodiment thereof, it will be appreciated by those skilled in the art that various changes in form and detail may be made without departing from the spirit and scope of the invention.

I claim:

1. A blind system comprising:

a main frame that is adapted to be attached to a building, the main frame having a first opening such that a hermetically sealed double glaze pane assembly is sealed within the first opening, the main frame having a rabbet on an interior surface, and the main frame having a series of second openings spaced about the first opening, the second openings located within the rabbet;

a series of screw bosses, each disposed within a respective one of the second openings;

a blind assembly removably disposed within the first opening in abutting relationship with the pane assembly; and a secondary frame having a third opening such that a single glaze pane is attached to the secondary frame in covering relationship with the third opening, the secondary frame being removably attachable to the main frame on overlying relationship with the blind assembly, by having the main frame receive the secondary frame within the rabbet and having a series of screws pass through the secondary frame, such that each screw is received within a respective one of the screw bosses.

2. The blind system as in claim 1 wherein the blind assembly is bordered by a spacer, the spacer is filled with a dessicant.

3. The blind assembly as in claim 2 wherein the spacer is adhered to the pane assembly and to a surface of the first opening of the main frame.

4. The blind assembly as in claim 3 further comprising a gasket attached to the single glaze pane on a first side of the gasket and the gasket attached to the blind assembly and the spacer on a second side of the gasket.

5. A blind system comprising:

a main frame that is adapted to be attached to a building, the main frame having a first opening such that a hermetically sealed double glaze pane assembly is sealed within the first opening, the main frame having a rabbet on an interior surface, and the main frame having a series of second openings spaced about the first opening, the second openings located within the rabbet;

a series of screw bosses, each disposed within a respective one of the second openings;

a spacer adhered to the pane assembly and to a surface of the first opening of the main frame;

a blind assembly removably disposed within the first opening in abutting relationship with the pane assembly and bordered by the spacer; and a secondary frame having a third opening such that a single glaze pane is attached to the secondary frame in covering relationship with the third opening, the secondary frame being removably attachable to the main frame by having the main frame receive the secondary frame within the rabbet and having a series of screws pass through the secondary frame, such that each screw is received within a respective one of the screw bosses.

6. The blind assembly as in claim 5 further comprising a gasket attached to the single glaze pane on a first side of the gasket and the gasket attached to the blind assembly and the spacer on a second side of the gasket.

7. The blind system as in claim 5 wherein the spacer is filled with a desiccant.

* * * * *